United States Patent [19]

Sato et al.

[11] Patent Number: 4,624,891

[45] Date of Patent: Nov. 25, 1986

[54] HEAT-SENSITIVE TRANSFER MATERIAL

[75] Inventors: Hiroshi Sato, Hiratsuka; Naoki Kushida; Kazumi Tanaka, both of Yokohama, all of Japan

[73] Assignee: Canon Kabushiki Kaisha, Tokyo, Japan

[21] Appl. No.: 706,277

[22] Filed: Feb. 27, 1985

[30] Foreign Application Priority Data

Mar. 9, 1984 [JP] Japan ..... 59-44878

[51] Int. Cl.[4] ..... B41M 5/26

[52] U.S. Cl. ..... 428/321.3; 428/195; 428/335; 428/336; 428/522; 428/913; 428/914

[58] Field of Search ..... 428/321.3, 488.1, 488.4, 428/913, 914, 195, 204, 207, 321.1, 335, 336, 484, 522

[56] References Cited

FOREIGN PATENT DOCUMENTS

| | | | |
|---|---|---|---|
| 0063000 | 10/1982 | European Pat. Off. | 428/321.3 |
| 0105579 | 8/1980 | Japan | 428/321.3 |
| 0188690 | 11/1983 | Japan | 428/321.3 |

*Primary Examiner*—Bruce H. Hess

*Attorney, Agent, or Firm*—Fitzpatrick, Cella, Harper & Scinto

[57] ABSTRACT

A heat-sensitive transfer material capable of giving transferred images of good printed letter quality even on a recording medium with poor surface smoothness, is provided by forming, on a support, a heat transfer layer comprising a micro-network porous resin structure of a thermoplastic resin and a heat-fusible gel ink contained in the micropores of the porous resin structure. The heat-fusible gel ink comprises a colorant, an oil incompatible with the thermoplastic resin and a gelation agent for the oil.

12 Claims, 3 Drawing Figures

HEAT-SENSITIVE TRANSFER MATERIAL

BACKGROUND OF THE INVENTION

This invention relates to a heat-sensitive transfer material which can give transferred recorded image of good printed letter quality even on a recording medium with poor surface smoothness.

With rapid progress of information industries, various information processing systems have been developed, and various recording methods and devices suited for the respective information processing systems have been developed and adopted. As one of such recording methods, the heat-sensitive recording method has recently been widely used because of various advantages such that the apparatus therefor is light in weight, compact, free of generating noise and also excellent in operability and maintenance.

However, of the recording papers used for the heat-sensitive recording method, ordinary heat-sensitive recording papers are expensive since they are converted papers containing a color forming agent and a developing agent, and also involve the problems that alteration of the recording is possible, that the recording paper is susceptible to color formation by heat or organic solvents and that the storability of the recording is poor with recorded image fading within a relatively short time.

As a method which maintains the advantages of the heat-sensitive recording method as described above and also compensates for the disadvantages with the use of heat-sensitive recording papers, the heat-sensitive transfer recording method is attracting attention.

The heat-sensitive transfer recording method employs a heat-sensitive transfer material, comprising generally a heat transferable ink containing a colorant dispersed in a heat-fusible binder applied by melting on a support in the form of a sheet. The heat-sensitive transfer material is superposed on the recording medium so that the heat-transferable ink layer may contact the recording medium, and the ink layer, melted by supplying heat through a thermal head from the support side of the heat-sensitive transfer material, is transferred onto the recording medium, thereby forming a transferred ink image corresponding to the pattern of the heat supplied on the recording medium. According to this method, the advantages of the heat-sensitive recording method as described above can be maintained, and also a plain paper can be used as a recording medium so that the above drawbacks accompanying the use of a heat-sensitive recording paper can be removed.

However, the heat-sensitive transfer recording method of the prior art is not free from drawbacks. That is, according to the heat-sensitive transfer recording method of the prior art, the transfer recording performance, namely the printed letter quality is greatly influenced by the surface smoothness, and therefore, although good quality of letter printing can be effected on a recording medium with a high degree of smoothness, the printed letter quality will be markedly lowered on a recording medium with a low degree of smoothness. However, even in the case of paper which is the most typical recording medium, a paper with high smoothness is rather special and the papers in general possess various degrees of concavities and convexities through entanglements of fibers. Accordingly, in the case of paper with a surface having a high degree of unevenness, the heated ink cannot penetrate into the fibers of the paper during transfer printing, but caused to adhere only at the convexities of the surface or in the vicinity thereof, with the result that the image printed at the edge portion is not sharp or a part of the image may be absent to lower the printed letter quality. For improvement of the printed letter quality, it may also be possible to use a heat-fusible binder having a low melting point. In this case, however, the heat transferable ink layer will have tackiness at a relatively low temperature to result in lowering storability or troubles such as staining at non-printed portions of the recording medium.

SUMMARY OF THE INVENTION

An object of the present invention is to remove the drawbacks in the heat-sensitive transfer recording method of the prior art and provide a heat-sensitive transfer material capable of giving printed letters of good quality not only on a recording medium having good surface smoothness but also on a recording medium having poor surface smoothness.

Another object of the invention is to provide a heat-sensitive transfer material capable of repeated use even on a recording medium with poor surface smoothness.

According to our study with the above objects in view, we have had a knowledge that it is very effective to form, instead of a layer of a conventional heat-fusible ink, a heat transfer layer comprising a micro-porous network resin structure and a heat-fusible gel ink on a support to provide a heat-sensitive transfer material. When the thus formed heat-sensitive transfer material is superposed on a recording medium with poor surface smoothness so that the heat transfer layer contacts the recording medium, and heat is supplied in a pattern to the heat transfer layer, the ink contained in the heat transfer layer loses its gel state and becomes a liquid with an extremely low viscosity close to that of an oil agent before the gelling and penetrates into concavities of the recording medium, whereby recorded images with high printed letter quality free of partially absent letter patterns can be obtained even on a recording medium with poor surface smoothness. Further, as the ink is contained in the gel state in micropores of the micro-porous network resin structure, the transfer layer is not tacky at room temperature in spite of its liquid-state penetration characteristic under heating so that it does not stain a recording medium when it contacts the latter. The storage stability of the transfer material is also improved.

The heat-sensitive transfer material according to the present invention is based on the above knowledge and, more specifically, comprises a support and a heat transfer layer formed on the support, said heat transfer layer comprising a micro-porous network resin structure of a thermoplastic resin and a heat-fusible gel ink contained in the micropores of the porous resin structure, said heat-fusible gel ink comprising a colorant, an oil incompatible with the thermoplastic resin, and a gelation agent for the oil.

The present invention will become more apparent upon consideration of the following description taken in conjunction with the accompanying drawings. In the following description, "%" and "parts" representing quantity ratios are by weight unless otherwise noted specifically.

DETAILED DESCRIPTION OF THE INVENTION

Figure 1:
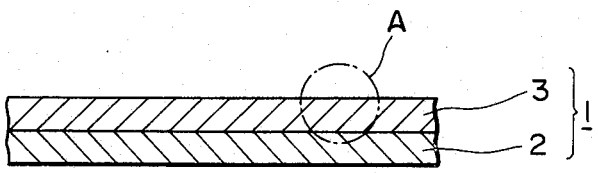
FIG. 1 is a schematic sectional view in the thickness direction of a basic embodiment of the heat-transfer material of the present invention.
Figure 2:
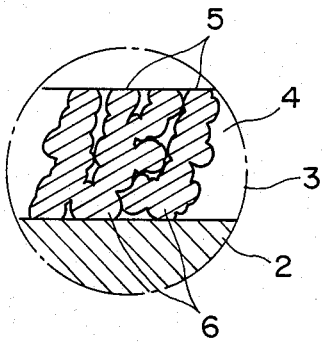
FIG. 2 is a schematic enlarged view of the portion A in FIG. 1.

FIG. 1 is a schematic sectional view in the thickness direction of a most basic embodiment of the heat-transfer material of the present invention and FIG. 2 is a schematic enlarged view of the portion A in FIG. 1. Thus, the heat-sensitive transfer material 1 is constituted of a support 2 which is generally in the form of a sheet (meant to be also inclusive of a film) and a heat transfer layer 3 formed on the support 2.

The support 2 may be any one of films and papers known in the art, which can be used as such. For example, films of plastics having relatively good heat resistance such as polyester, polycarbonate, triacetylcellulose, nylon, polyimide, etc., cellophane or parchment paper can preferably be used. The support should desirably have a thickness of 2 to 15 microns, when a thermal head is used as the heat source for heat transfer. However, when a heat source capable of heating selectively the heat transferable ink layer such as laser beam, etc., is used, there is no particular limitation with respect to the thickness. Where a thermal head is used, the heat resistance of the support can be improved by providing a heat resistant protective layer of silicone resin, fluorine resin, polyimide resin, epoxy resin, phenol resin, melamine resin or nitrocellulose, or a support material which could not be used in the prior art may become available by giving such protective layer.

The heat transfer layer 3 comprises a micro-porous network resin structure of a thermoplastic resin or, simply, a microporous resin matrix 4 of a thermoplastic resin. The micropores 5 of the porous resin structure are filled with a heat transferable ink 6 which is a heat-fusible gel ink comprising a colorant, an oil which is incompatible with the resin constituting the micro-porous network resin structure 4, and a gelation agent for the oil.

The method for preparation of the heat transfer layer 3 having a structure as described above is not particularly limited, but a method as described below is generally employed. For example, an oil and a colorant are mixed and dispersed together with a suitable organic solvent by means of a dispersing device such as an attritor to obtain a dispersion (inclusive of a solution) of the colorant. A gelation agent is dispersed in and mixed with the dispersion. The mixture is heated until the gelation agent is dissolved and thereafter cooled to obtain a solid ink. Separately, a solution of a thermoplastic resin dissolved in an organic solvent is prepared, and the solution is mixed with the above solid ink, and the mixture is homogeneously dispersed by a mixing means such as a ball mill. Then, the dispersion thus obtained is applied on a support and dried to give a heat-sensitive transfer material 1 of the present invention having a heat-transfer layer 3 with a microporous structure as mentioned above. In the dispersion, a wetting agent may be added for improvement in dispersibility of the oil and the colorant. The thermoplastic resin constituting the micro-porous network resin structure should preferably be a homopolymer or a copolymer of at least one monomer selected from vinyl monomers and acrylic monomers such as vinyl chloride, vinyl acetate, vinylidene chloride, acrylic acid, methacrylic acid, acrylic acid ester and methacrylic acid ester, in connection with the oil as described hereinafter.

The oil may be a non-volatile oil which is incompatible with the thermoplastic resin as described above. Specific examples of the oil include animal and vegetable oils such as cottonseed oil, rapeseed oil, whale oil, etc.; mineral oils such as motor oil, spindle oil, dynamo oil, etc.; and esters such as fatty acid esters such as octyl oleate and sorbitan fatty acid esters. These oils may be used either singly or as a mixture of two or more kinds.

Further, a semi-solid such as lanolin, vaseline and lard, or a solid such as various kinds of waxes, may be mixed with the above-mentioned oils as far as an oil mixture which is liquid at room temperature is obtained thereby.

Several kinds of gelation agents are known for the above-mentioned oils. Specific examples thereof include: metallic soaps showing a gelation function for mineral oils or non-polar solvents, e.g., salts of carboxylic acids such as stearic acid, oleic acid, lauric acid and an octanoic acid (particularly, 2-ethylhexanoic acid) with a metal such as Al, Zn, Ca, Mg and Na; hydroxypropyl cellulose derivatives showing a gelation effect for vegetable oil, mineral oils, aromatic oils, alcohols, ester oils, etc., e.g., hydroxypropyl cellulose laurate, and hydroxypropyl cellulose acetate; di- or tri-benzylidene sorbitol especially useful for gelation of polar oils such as alcohols and esters; dextrin fatty acid esters effective for gelation of hydrocarbon oils, higher fatty acid esters, aromatic oils and halogenated hydrocarbon oils; polyethylene having a low molecular weight (e.g., 1100 to 5000) effective for gelation of mineral oils, ester oils, etc.; and other gelation agents for oils including thermoplastic polyamide resins, higher fatty acid esters, N-acyl-amino acid derivatives, alkylstyrene polymers, fatty acid esters of sucrose, and dextran esters. The mechanisms of gelation with these gelation agents are not uniform but in variety, e.g., formation of micelles due to association, intermolecular association, agglomeration gelation, or combination of these. Further, some of the gelation mechanisms has not been clarified. However, for the purporse of the present invention, among the above enumerated gelation agents, such a kind and amount of gelation agent is selected and used for an oil used that it acts on the oil to transform the oil from a liquid state into a solid under room temperature condition, preferably one having a melting temperature in the range of from 50° to 150° C. It is particularly preferred that 0.2 to 15 parts, especially 1 to 8 parts, of a gelation agent is used for 100 parts of an oil. Furthermore, a particular gelation agent to be used should be selected in this regard. Two or more gelation agents may be used in combination, as desired. Further information about details of gelation agents and gelation mechanisms thereby may be obtained by, e.g., Fragrance Journal No. 33 (1978), p.p. 26–31 and p.p. 52–56; "Cosmetics and Toiletries", Vol. 92 (1977); February issue p.p. 25–26 and September issue p.p. 39–40; Japanese Patent Publication No. 12948/1979, Japanese Patent Laid - Open Appln. No. 136669/1983, etc.

The colorant to be used in the present invention may be selected from any of the known dyes and pigments including carbon black, nigrosine dyes, lampblack, Sudan Black SM, Alkali Blue, Fast Yellow G, Benzidine Yellow, Pigment Yellow, Indofast Orange, Irgadine Red, Paranitroaniline Red, Toluidine Red, Carmine FB, Permanent Bordeaux FRR, Pigment Orange R, Lithol Red 20, Lake Red C, Rhodamine FB, Rhodamine B Lake, Methyl Violet B Lake, Phthalocyanine Green, Oil Yellow G.G., Zapon Fast Yellow CGG, Kayaset Y963, Kayaset YG, Smiplast Yellow, Zapon Fast Orange RR, Oil Scarlet, Smiplast Orange G, Orasol Brown B, Zapon Fast Scarlet CG, Aizen Spiron Red BEH, Oil Pink OP, Victoria Blue F4R, Fastgen Blue 5007, Sudan Blue, and Oil Peacock Blue. These colorants may be used in a proportion of the order of 4 to 40 parts per 100 parts of the oil.

The heat transfer layer 3 of the heat-sensitive recording material according to the present invention is preferably formed by 100 parts of the thermoplastic resin constituting the porous network structure 4 and 50 to 200 parts, particularly 100 to 200 parts, of the heat-fusible gel ink 6. The heat-transfer layer 3 preferably has a thickness in the range of 2 to 30μ, particularly 4 to 25μ. A relatively thin thickness gives a heat-sensitive transfer material adapted for a single time of use and a larger thickness gives a heat-sensitive transfer material adapted for repeated use. For repeated use, the heat transfer layer 3 should preferably have a thickness in the range of 8 to 25μ. While not specifically shown in the figure, an adhesive layer of a resin such as a polyester resin and a polyurethane resin with a thickness of the order of 1μ may be provided, as desired, between the heat transfer layer 3 and the support 2.

Figure 3:
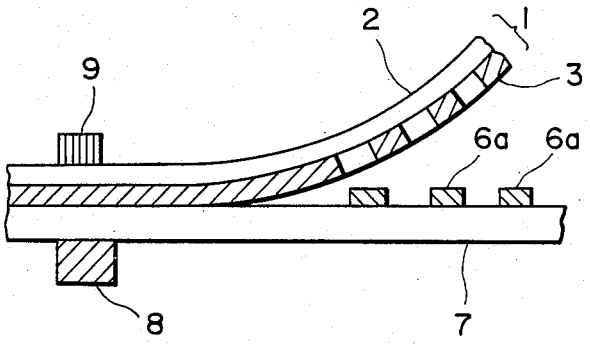
FIG. 3 is a schematic sectional view in the thickness direction of the heat-transfer material for illustration of an embodiment of the heat-sensitive transfer recording method of the present invention.

Operation required for the heat transfer recording method employing the above explained heat transfer material is not particularly different from that of the conventional method and will be described hereinbelow with reference to a typical embodiment thereof. FIG. 3 is a schematic sectional view in the thickness direction of the heat-sensitive transfer material showing an outline thereof. More specifically, the heat transfer layer 3 of the heat transfer material 1 is brought to contact a recording medium such as a plain paper, and heat is applied from a thermal head 9 (or by a laser beam) to heat the heat transfer layer locally or in a pattern corresponding to a desired printing letter or transfer pattern, preferably at a position corresponding to a platen. At the heated portion of the heat transfer layer 3, the heat-fusible ink contained in the micro-structure is caused to assume a liquid state of a lower surface tension and viscosity and is pushed out of the micropores to adhere to or penetrate into even the surface concavities of the recording medium, so that good transfer recorded image 6*a* of good printed letter quality corresponding to a heated pattern can be given on the recording medium 7 after separation of the heat-sensitive transfer material 1.

As described in detail above, according to the present invention, by making the heat transfer layer a microporous network resin structure and incorporating a heat-fusible gel ink with good penetrability under heating in the micropores thereof, a heat-sensitive transfer material can be provided, which is capable of giving a recorded image of good printed letter quality without defect or flaw in the printed letter even on a recording medium with poor surface smoothness, and also suppressed in surface tackiness under storage condition.

The present invention is described in more detail by referring to the following Examples.

EXAMPLE 1

| | |
|---|---|
| Carbon black | 10 parts |
| Alkali Blue powder | 5 parts |
| Nigrosine-type black dye | 5 parts |
| Sorbitan mono-oleate | 80 parts |

The above components were mixed and dispersed together with glass beads for 30 min. by means of a sand mill to prepare a colored dispersion A.

To 97 parts of the colored dispersion A, 3 parts of a dibenzylidene sorbitol-base oil gelation agent (Gel-ol D, produced by Shinnihon Rika K. K.) was added, and the resultant mixture was heated up to around 140° C. under stiring with a magnetic stirrer to dissolve the gelation agent therein. After stopping the stirring, the mixture was cooled to room temperature to obtain a black gel B. To 10 parts of the black gel B was added 30 parts of a resin liquid comprising a 20 wt. % solution of vinyl chloride/vinyl acetate copolymer in a 1:1 mixture solvent of ethyl acetate and toluene. The mixture was stirred for 20 min. with a homo-mixer to obtain a coating liquid for producing heat transfer layer.

The coating liquid was applied on a polyester film of 6μ in thickness with a wire bar and dried to form a heat-sensitive transfer material having an 8μ thick transfer layer containing a gel ink in a micro-porous network resin structure.

EXAMPLE 2

| | |
|---|---|
| Isopar M (an isoparaffin-base solvent available from Esso Co.) | 83 parts |
| Nigrosine dye | 10 parts |
| Aluminum stearate | 7 parts |

The above components where heated under stirring up to 130° C. to dissolve the dye and the aluminum stearate and then cooled after stopping the stirring to form a black gel C.

By using the black gel C in place of the black gel B, a coating liquid was obtained in a similar manner as in Example 1.

The coating liquid was applied on a polyester film of 6μ in thickness with a wire bar and dried to form a heat-sensitive transfer material having an 8μ-thick transfer layer containing a gel ink in a micro-porous network resin structure.

EXAMPLE 3

A heat-sensitive transfer material was produced in the same manner as in Example 1 except that the heat transfer layer was formed in a thickness of 15μ.

EXAMPLE 4

A heat-sensitive transfer material was produced in the same manner as in Example 1 except that 10 parts of the black gel B was mixed with 70 parts of the resin liquid comprising a 20 wt. % solution of vinyl chloride/vinyl acetate copolymer in a 1:1 mixture solvent of ethyl acetate and toluene.

COMPARATIVE EXAMPLE 1

In an attritor heated at 100° C., 10 parts of carbon black, 10 parts of carnauba wax, 35 parts of oxidized wax and 45 parts of paraffin were melted and kneaded so that the carbon black was well dispersed to form an ink. The ink was coated under hot melted state with a Meyer bar on a polyethyleneterephthalate film of 6μ in thickness to form a heat-sensitive transfer material having a 4μ-thick heat-sensitive transfer layer.

COMPARATIVE EXAMPLE 2

A heat-sensitive transfer material was prepared in the same manner as in Example 1 except that the gelation agent (Gel-ol D) was omitted.

COMPARATIVE EXAMPLE 3

A heat-sensitive transfer material was prepared in the same manner as in Example 2 except that the aluminum stearate was omitted from the ink.

The heat-sensitive transfer materials obtained in the above described Examples 1–4 and Comparative Examples, were respectively subjected to a recording test by the use of a heat-sensitive transfer type printer of a Japanese-language word processor (CanoWord 45 produced by Canon K. K.). The recording was performed under the normal operation conditions on wood free paper with Bekk surface smoothness of 100 sec. with respect to ordinary type faces. The transfer material of Example 3 once used was re-used for the same recording test. The printed letters were evaluated visually. The heat-sensitive transfer materials of Examples 1 to 4 and Comparative Example 1 gave good quality of black letters. Especially, the transfer material of Example 3 gave good quality of letter both in the first recording and the second recording.

On the contrary, the heat-sensitive transfer materials of Comparative Examples 2 and 3 gave poor quality of letters. Thus the ink was also transferred around the letter portions and the letters could not be easily read.

Then, the heat-sensitive materials of Examples 1–4 and Comparative Example 1 which gave good results in the above test were subjected to measurement of reflective densities on different qualities of papers including wood free paper with Bekk smoothness of 100 sec., and bond papers with Bekk smoothness of 20 sec. and 12 sec. by using the above-mentioned heat-sensitive transfer type printer under the normal conditions. After the recording, the reflective density of the printed letters was measured.

The reflective density was measured with respect to a solid printed portion by means of a micro-densitometer and expressed in terms of: −log (intensity of reflected light/intensity of incident light). The light-irradiated portion measured 200 μm in longitudinal length and 20 μm in transverse length and was scanned for 300 μm in the transverse direction to measure the reflective density. The results of the measurement are shown in Table 1.

In Table 1, the reflective density is shown as an average reflective density and a density difference between thick and pale portions. The average reflection density refers to an average value of the reflection density measured during one time of scanning. The density difference between thick and pale portions refers to a difference in reflective density between the thickest portion and the palest portion during one time of scanning.

The scanning was repeated 5 times for the measurement with respect to different parts of one printed letter. Table 1 lists average values of measured data for the 5 times of scanning.

The heat-sensitive transfer material of Example 3 was re-used again for repeating the reflective density test twice in order to evaluate the adaptability for re-use.

TABLE 1

| | | | Reflective density | | | |
|---|---|---|---|---|---|---|
| | | | Average reflective density | | Density difference | |
| Example 1 | Wood free paper | (100 sec.) | 1.30 | | 0.15 | |
| | Bond paper | (20 sec.) | 1.27 | | 0.23 | |
| | Bond paper | (12 sec.) | 1.25 | | 0.26 | |
| Example 2 | Wood free paper | (100 sec.) | 1.25 | | 0.18 | |
| | Bond paper | (20 sec.) | 1.23 | | 0.20 | |
| | Bond paper | (12 sec.) | 1.20 | | 0.28 | |
| | | | 1st | 2nd | 1st | 2nd |
| Example 3 | Wood free paper | (100 sec.) | 1.25 | 1.22 | 0.16 | 0.17 |
| | Bond paper | (20 sec.) | 1.22 | 1.20 | 0.20 | 0.19 |
| | Bond paper | (12 sec.) | 1.19 | 1.20 | 0.27 | 0.29 |
| Example 4 | Wood free paper | (100 sec.) | 1.24 | | 0.25 | |
| | Bond paper | (20 sec.) | 1.22 | | 0.27 | |
| | Bond paper | (12 sec.) | 1.23 | | 0.29 | |
| Comparative Example 1 | Wood free paper | (100 sec.) | 1.28 | | 0.30 | |
| | Bond paper | (20 sec.) | 1.15 | | 0.60 | |
| | Bond paper | (12 sec.) | 1.00 | | 0.65 | |

As apparent from Table 1 above, the heat-sensitive transfer material according to the present invention gives little difference in reflective density for variety of Bekk smoothness of recording paper and thus gives good recorded images even on a recording medium of poor surface smoothness. Table 1 further shows that the heat-sensitive transfer material of the present invention gives printed letters with little density difference between thick and pale portions.

What is claimed is:

1. A heat-sensitive transfer material, comprising: a support and a heat transfer layer formed on the support, said heat transfer layer comprising a micro-porous network resin structure of a thermoplastic resin and a heat-fusible gel ink contained in the micropores of said resin structure, said heat-fusible gel ink comprising a colorant, an oil incompatible with the thermoplastic resin and a gelation agent for the oil.

2. The heat-sensitive transfer material according to claim 1, wherein said heat-fusible ink has a melting point of from 50° to 150° C.

3. The heat-sensitive transfer material according to claim 1, wherein said gelation agent is contained in a proportion of 0.2 to 15 parts by weight with respect to 100 parts by weight of the oil.

4. The heat-sensitive transfer material according to claim 3, wherein said gelation agent is contained in a proportion of 1 to 8 parts by weight with respect to 100 parts by weight of the oil.

5. The heat-sensitive transfer material according to claim 1, wherein said colorant is contained in a proportion of 4 to 40 parts by weight with respect to 100 parts by weight of the oil.

6. The heat-sensitive transfer material according to claim 1, wherein said heat-fusible gel ink is contained in a proportion of 50 to 200 parts by weight with respect to 100 parts by weight of the thermoplastic resin.

7. The heat-sensitive transfer material according to claim 6, wherein said heat-fusible gel ink is contained in a proportion of 50 to 200 parts by weight with respect to 100 parts by weight of the thermoplastic resin.

8. The heat-sensitive transfer material according to claim 1, wherein said heat transfer layer has a thickness of from 2 to 30μ.

9. The heat-sensitive transfer material according to claim 1, wherein said heat transfer layer has a thickness of from 4 to 25μ.

10. The heat-sensitive transfer material according to claim 1, wherein said heat transfer layer has a thickness of from 8 to 25μ.

11. The heat-sensitive transfer material according to claim 1, wherein an adhesive layer is provided between the heat transfer layer and the support.

12. The heat-sensitive transfer material according to claim 1, wherein said thermoplastic resin comprises a vinyl chloride/vinyl acetate copolymer, and said oil comprises sorbitan mono-oleate.

* * * * *